United States Patent [19]

Kamp et al.

[11] Patent Number: 4,915,315

[45] Date of Patent: Apr. 10, 1990

[54] YARN TRAVERSING-WINDING APPARATUS WITH AN ENDLESS BELT HAVING SENSOR DETACTABLE INLAYS

[75] Inventors: Heinz Kamp, Wegberg; Rolf Becker, Mönchen-Gladbach, both of Fed. Rep. of Germany

[73] Assignee: W. Schlafhorst & Co., Mönchen-Gladbach, Fed. Rep. of Germany

[21] Appl. No.: 276,058

[22] Filed: Nov. 25, 1988

[30] Foreign Application Priority Data

Nov. 24, 1987 [DE] Fed. Rep. of Germany ..... 3739693

[51] Int. Cl.[4] ..... B65H 63/00; B65H 54/28; B65H 57/28

[52] U.S. Cl. ..... 242/43 A; 242/36; 242/158 B

[58] Field of Search ..... 242/43 A, 158 B, 36, 242/43 R; 474/260, 263, 268, 102

[56] References Cited

U.S. PATENT DOCUMENTS

| | | | |
|---|---|---|---|
| 2,690,985 | 10/1954 | Poole . | |
| 3,179,241 | 4/1965 | Kain | 474/102 X |
| 3,310,161 | 3/1967 | Kraft Jr. . | |
| 4,349,160 | 9/1982 | Niederer | 242/158 B X |
| 4,453,678 | 6/1984 | Andonou et al. | 242/158 B X |
| 4,681,275 | 7/1987 | Honczarenko | 242/158 B X |
| 4,807,822 | 2/1989 | Kamp et al. | 242/43 R |

FOREIGN PATENT DOCUMENTS

| | | |
|---|---|---|
| 3627516 | 2/1988 | Fed. Rep. of Germany . |
| 77107 | 11/1970 | German Democratic Rep. . |

*Primary Examiner*—Stanley N. Gilreath
*Assistant Examiner*—E. Dunlap
*Attorney, Agent, or Firm*—Herbert L. Lerner; Laurence A. Greenberg

[57] ABSTRACT

A yarn traverse-winding apparatus of a textile machine producing cross-wound bobbins has a given traversing width and an endless yarn traversing belt. The belt has a belt body, yarn drivers spaced apart along the belt body, and inlays spaced apart within the belt body at intervals smaller than the given traversing width. The inlays are individually detectable by a sensor aimed at the yarn traversing belt.

12 Claims, 2 Drawing Sheets

YARN TRAVERSING-WINDING APPARATUS WITH AN ENDLESS BELT HAVING SENSOR DETACTABLE INLAYS

BACKGROUND OF THE INVENTION

1. Field of the Invention:

The invention relates to an endless yarn traversing belt for a yarn traverse-winding apparatus of a textile machine that produces cross-wound bobbins or cheeses and is provided with yarn drivers at intervals.

2. Description of the Related Art:

During the winding of cross-wound bobbins, it is sometimes necessary to monitor, vary, control or regulate the yarn traversing speed. For instance, by controlling the yarn traversing apparatus, it is possible to avoid so-called ribbon winding of the cross-wound bobbin, or to produce so-called precision cheeses.

SUMMARY OF THE INVENTION

It is accordingly an object of the invention to provide an endless, flexible yarn traversing belt for a yarn traversing apparatus, which overcomes the hereinaforementioned disadvantages of the heretofore-known devices of this general type and to do so in such a way that good monitoring, control or regulation of the yarn traversing becomes possible.

With the foregoing and other objects in view there is provided, in accordance with the invention, an endless yarn traversing belt in a yarn traverse-winding apparatus of a textile machine producing cross-wound bobbins having a given traversing width, comprising a belt body, yarn drivers spaced apart along the belt body, and inlays or inserts spaced apart within the belt body at intervals smaller than the given traversing width, the inlays being individually detectable through measuring by a sensor aimed at the yarn traversing belt.

In accordance with another feature of the invention, the belt travels in a given belt travel direction, the inlays are spaced apart by intervals of between a few millimeters and several centimeters, and the inlays are oriented transversely to the given belt travel direction.

Since the yarn traversing belt travels past a sensor, the inlays which are preferably provided at equal intervals on the yarn traversing belt are detected by the sensor, for instance in the form of pulses. If the travel speed of the belt changes, then the time interval between the pulses detected by the sensor also changes. In this way, the travel state or travel speed of the yarn traversing belt can be sensitively detected in any phase of the winding process. This does not preclude still further special identification of the location of the yarn drivers or the revolution of the belt by means of special inlays that are different from the others. As a result, the location of a particular yarn driver, or the passage of the yarn driver past a particular point, can additionally be detected by a proximity sensor. The revolution of the belt can also be counted with the aid of a special inlay. The revolution time of the belt can be measured at the same time.

In accordance with a further feature of the invention, the inlays are formed of electrically conductive or semiconducting material and/or ferromagnetic material.

Examples of electrically conductive inlays are metal wires or tapes. They may at the same time be magnetic or may be made of ferromagnetic material, such as iron. They may, for example, also be formed of acoustic recording tape or a material like that used in acoustic recording tape. Correspondingly, specific proximity sensors which, for instance, respond to metals or to magnetic fields, can be used as the sensors.

In accordance with an added feature of the invention, the belt body has remaining belt material in which the inlays are disposed, and the inlays have a relative dielectric constant differing from that of the environment and/or of the remaining belt material. There are a number of materials with relative dielectric constants greater than the dielectric constant of air. Among these are rubber, mica, thermoplastic plastics and electrets, for example.

The invention permits monitoring of the traversing by means of capacitive or inductive measuring sensors, for instance. These primary pickups may represent the first member of a measuring chain, which may including means for amplification and conditioning of measurement variables, calculating operations and the emission of a measurement value.

In accordance with an additional feature of the invention, the belt travels in a given belt travel direction, and at least one of the inlays is woven and includes intersecting thread warps or sheets with sensor-detectable threads or thread groups spaced apart transversely to the given belt travel direction. Alternatively, the sensor may be a measuring roller that touches the belt. One of the guide rollers may be in the form of a measuring roller.

One thread warp suitably extends substantially in the travel direction of the belt. The other thread warp or thread warps extend transversely to it. In this connection, the orientation in which it extends at right angles to the belt travel direction is a preferred special case.

The thread warp disposed transversely to the belt travel direction may, for example, only be formed of the threads or thread groups that are detectable by a sensor. However, threads or thread groups may also be contained in the same thread warp that cannot be detected by sensor or cannot be detected as well by sensor.

In accordance with yet another feature of the invention, the belt travels in a given belt travel direction, the inlays are woven and are formed of warp threads and weft threads, and the weft threads, which art preferably the sensor-detectable threads, extend transversely to the given belt travel direction.

Woven inlays of this kind can, for instance, be produced on automatic looms. The laying-in of sensor-detectable weft threads into the corresponding thread warp can be controlled in a simple fashion even on the weaving machine, in such a way as to produce the desired and in particular uniform intervals.

In accordance with a concomitant feature of the invention, the thread warps extending transversely to the belt travel direction in the woven inlay are alternatingly formed of the sensor-detectable threads of thread groups and threads or thread groups that are less or non-sensor-detectable. Such a configuration is also appropriate for improving the mechanical strength of the yarn traversing belt.

Other features which are considered as characteristic for the invention are set forth in the appended claims.

Although the invention is illustrated and described herein as embodied in an endless yarn traversing belt, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
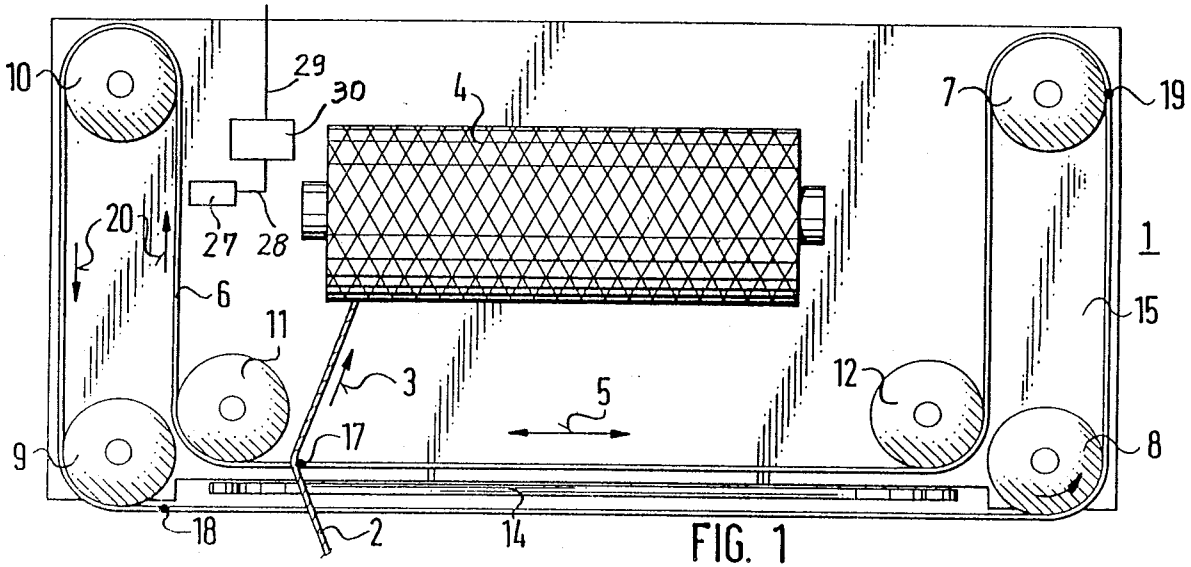
FIG. 1 is a top-plan view of a yarn traversing apparatus.
Figure 2:
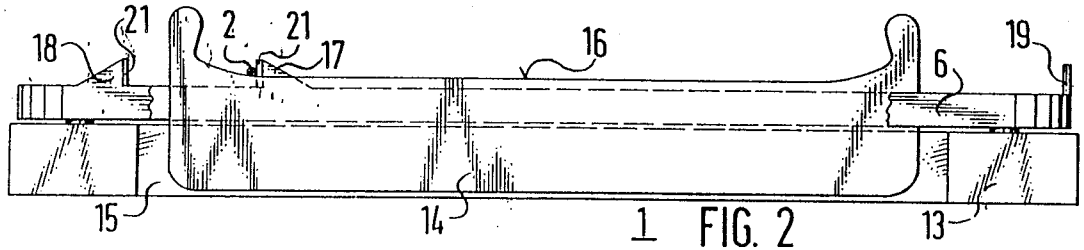
FIG. 2 is an enlarged, partially broken-away, front-elevational view of the apparatus of FIG. 1.

Referring now to the figures of the drawing in detail and first, particularly, to FIGS. 1 and 2 thereof, there is seen a yarn traverse winding apparatus of a textile machine that produces cross-wound bobbins, which is indicated overall by reference numeral 1. Yarn 2 is supplied with the aid of the yarn traverse winding apparatus 1 in the direction of an arrow 3 to a rotating cheese or cross-wound bobbin 4 where it is wound in cross-wound layers. To this end, the yarn traverse winding apparatus 1 causes the yarn 2 to traverse continuously in the direction of a double arrow 5. An endless yarn traversing belt 6 is used for traversing. The yarn traversing belt 6 wraps around rollers 7-12. The roller 8 has a drive motor 13. All six rollers are supported on a support body 15. The support body 15 also supports a yarn guide plate 14. The yarn guide plate 14 has a yarn guide contour 16, which follows a course that rises toward the ends of a traversing zone, as shown in FIG. 2.

The endless, flexible yarn traversing belt 6 is provided with three yarn drivers, dogs or entrainers 17, 18, 19 at intervals along the body of the belt. All three yarn drivers are disposed on the narrow side or edge of the yarn traversing belt and have the shape of a sawtooth.

The leading edges of the yarn drivers 17–19 are oriented in the travel direction 20 of the yarn traversing belt 6 and are each provided with a sheath-like reinforcement 21 of wear-resistant material.

At the point in time during the operation of the device which is shown in FIG. 2, the yarn driver 17 is just moving toward the left. In so doing, it takes along the yarn 2 and causes it to slide along the yarn guide contour 16 of the yarn guide plate 14, until the yarn driver 17 disappears behind the rising edge of the yarn guide contour 16 and gives up the yarn 2, which is then engaged by the yarn driver 18 that is moving from left to right, so that the yarn is then traversed from left to right, until the yarn is subsequently engaged by the third driver 19 which then traverses it back from right to left, and so forth.

In FIG. 1, the yarn drivers 17–19 are represened merely by dots, for the sake of simplicity.

Figure 3:
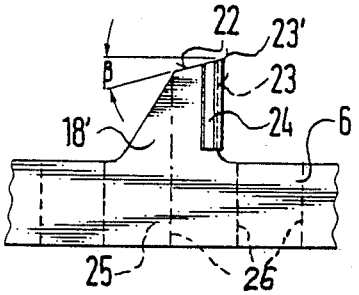
FIG. 3 is a further enlarged, fragmentary, side-elevational view of another embodiment of the yarn traversing belt.

As seen in the embodiment of FIG. 3, the body of the yarn traversing belt 6 has a woven inlay or insert 25 which is embedded in rubber-elastic material. The inlay 25 is made of textile threads that extend in the belt travel direction and form warp threads with which weft threads 26 are tied. The weft threads 26 are made of metal and provide sensor-detectable inlays, which are tied-in continuously with the warp threads 25, at intervals of 11.5 mm. It is understood that the same inlays are also provided in the embodiment of FIGS. 1 and 2.

FIG. 2 shows that the steep edges of the yarn drivers 17 and 18 are perpendicular to the yarn traversing belt 6. The same is true for the yarn driver 19.

Figure 4:
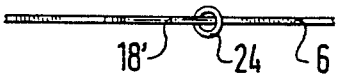
FIG. 4 is a top-plan view of the belt of FIG. 3.

FIGS. 3 and 4 also show an alternative embodiment of the yarn traversing belt 6, wherein a trailing edge 22 of a yarn driver 18′ has a convexly interrupted course. The trailing edge 22 extends from an end 23′ of a leading edge 23 and is inclined at an angle $\beta$ of approximately 10° with respect to the yarn traversing belt 6. After a change in direction, the trailing edge 22 then has an increased inclination.

It is particularly seen from FIG. 3 that the transitions between the yarn traversing belt 6 and the yarn driver 18′ are rounded.

In the embodiment illustrated in FIGS. 3 and 4, a reinforcement 24 is formed of a resilient sheath or sleeve having a longitudinal slit formed therein and being fitted over the leading edge 23. the sheath is inherently resilient and therefore provides a spring force which force-lockingly connects the sheath to yarn driver 18′. A force-locking connection is one which connects two elements together by force, as opposed to a form-locking connection which is provided by the shapes of the elements themselves. The sheath 24 is made of rust-resistant or stainless steel.

The yarn traversing belt 6 is manufactured as follows: First, a woven fabric is produced from textile threads, which was first temporarily wound-up in several layers. The woven inlays 25, 26 shown in FIG. 3 are applied as a cover layer. The layers located one above the other are then drawn off from the winding body once again, passed through a rubberizing bath, and then automatically vulcanized, producing a tension-proof flexible belt with low stretch in the tension direction. This belt is then cut up into a plurality of belts. Traversing belt blanks are then first produced from each of these belts, by stamping out the yarn drivers. Each traversing belt blank is then scarfed on both ends. The ends are then overlappingly vulcanized together. Next, the three yarn drivers are provided with their reinforcements. At the vulcanized junction, the spacing of the weft threads 26 from one another is greater or less than 12.5 mm.

According to FIG. 1, the yarn traversing belt 6 moves past a contactless measurement pickup 27, which sends a pulse through a line 28 to an evaluation unit 30 whenever a metal weft thread 26 travels past the measurement pickup 27. The traversing speed is ascertained in the evaluation unit 30, such as from the temporal spacing of the pulses, among other factors. If the drive motor 13 is operationally connected to the evaluation unit 30 by a line 29, for instance, then a regulating circuit for constant regulation of the traversing speed can be provided. On the other hand, however, the tranversing speed can also be coordinated with the rotational speed of the cheese 4. This can be done in accordance with previously defined fixed values, or it can be variable in accordance with the progression of the winding of the bobbin.

However, the evaluation unit 30 may also act upon the drive motor 13 like a so-called ribbon malfunction unit, in order to prevent so-called ribbon windings on the cheese. In that case, the drive motor 13 is varied in such a way that the traversing speed changes accordingly, at least for the critical diameter ranges of the cheese 4.

If a precision cheese is to be produced instead of a random winding, then ratio of the rotational speed of the bobbin to the number of double strokes of the traverse motion can be kept constant by means of the evaluation unit 30, so that the desired constant number of yarn intersections over the bobbin length is attained for each bobbin diameter.

On the other hand, the evaluation unit 30 may also ascertain the location of the seam of the yarn traversing belt 6, because of the different spacing of the sensor-detectable weft threads present there, and it thus can ascertain at what time the yarn traversing belt 6 has completed one revolution.

Alternatively, the yarn traversing belt 6 may also be manufactured as follows:

First, a woven belt is produced from textile threads and wound in several layers onto a drum having a circumference which is the length of the yarn traversing belt to be made on it. Either the lowermost, uppermost or a middle layer, then receives the sensor-detectable weft threads. All of the layers are then rubberized and vulcanized on the drum and then cut off of the drum after the vulcanization and cut to length. The reinforcements 21, 24 are then applied.

We claim:

1. Yarn traverse-winding apparatus of a textile machine producing cross-wound bobbins having a given traversing width, comprising an endless yarn traversing belt having a belt body, means for continuously driving said yarn traversing belt in one given yarn travel direction at a given traversing speed, yarn drivers spaced apart along said belt body, inlays formed of a given material being spaced apart within said belt body throughout said yarn traversing belt at intervals smaller than said given traversing width, a sensor aimed at said yarn traversing belt for detecting said given material and individually counting said inlays, and an evaluation unit connected between said sensor and said driving means, said unit adjusting said given traversing speed in response to said sensor.

2. Yarn traverse-winding apparatus according to claim 1, wherein said inlays are spaced apart by intervals of at least a plurality of millimeters, and said inlays having longitudinal axis oriented transversely to said given belt travel direction.

3. Yarn traverse-winding apparatus according to claim 1, wherein said inlays are formed of electrically conductive material.

4. Yarn traverse-winding apparatus according to claim 1, wherein said inlays are formed of semiconductive material.

5. Yarn traverse-winding apparatus according to claim 1, wherein said inlays are formed of ferromagnetic material.

6. Yarn traverse-winding apparatus according to claim 1, wherein said inlays have a relative dielectric constant differing from that of air.

7. Yarn traversing belt according to claim 1, wherein said belt body has remaining belt material in which said inlays are disposed, and said inlays have a relative dielectric constant differing from that of said remaining belt material.

8. Yarn traverse-winding apparatus according to claim 1, wherein said belt body has remaining belt material in which said inlays are disposed, and said inlays have a relative dielectric constant differing from that of air and of said remaining belt material.

9. Yarn traverse-winding apparatus according to claim 1, wherein said belt travels in a given belt travel direction, and at least one of said inlays is woven and includes intersecting thread warps with threads being detectable by said sensor and being spaced apart transversely to said given belt travel direction.

10. Yarn traverse-winding apparatus according to claim 1, wherein said belt travels in a given belt travel direction, said inlays are woven and are formed of warp threads and weft theads, and said weft threads extend transversely to said given belt travel direction.

11. Yarn traverse-winding apparatus according to claim 10, wherein said weft threads are detectable by said sensor.

12. Yarn traverse-winding apparatus according to claim 9, wherein said thread warps extending transversely to the belt travel direction in said woven inlay are alternatingly formed of said threads being detectable by said sensor and threads not being detactable by said sensor.

* * * * *